US005088425A

United States Patent [19]

Adams

[11] Patent Number: 5,088,425

[45] Date of Patent: Feb. 18, 1992

[54] COMFORTER ASSEMBLY APPARATUS

[75] Inventor: Rex A. Adams, Omaha, Nebr.

[73] Assignee: Products Unlimited, Inc., Omaha, Nebr.

[21] Appl. No.: 492,079

[22] Filed: Mar. 9, 1990

[51] Int. Cl.[5] ..... D05B 11/00

[52] U.S. Cl. ..... 112/117; 112/63; 112/262.2; 112/262.3; 112/155; 53/524

[58] Field of Search ..... 112/262.2, 262.1, 262.3, 112/117, 118, 119, 10, 63, 147, 121.15, 121.27, 307, 2, 155, 420, 440, 441; 53/524, 258

[56] References Cited

U.S. PATENT DOCUMENTS

| | | | |
|---|---|---|---|
| 2,281,308 | 4/1942 | Johnson | 112/63 X |
| 2,428,943 | 10/1947 | Plummer, Jr. | 112/63 X |
| 3,198,149 | 8/1965 | Schlegel | 112/420 X |
| 3,664,090 | 5/1972 | Atkin | 53/258 |
| 4,223,510 | 9/1980 | Cash | 53/258 |
| 4,893,574 | 1/1990 | O'Neal et al. | 12/262.3 X |

*Primary Examiner*—Peter Nerbun

*Attorney, Agent, or Firm*—Zarley McKee Thomte Voorhees & Sease

[57] ABSTRACT

A comforter assembly apparatus includes a frame with first and second rolls of fabric associated therewith for supplying an upper sheet and a lower sheet to the apparatus. A pair of sewing machines are mounted on the frame so as to attach the side edges of the upper and lower sheets together to form a continuous fabric assembly. The fabric assembly surrounds, and is pulled through the interior of, a turning ring, so as to continuously invert the fabric assembly into an inside-out condition. A third layer of soft batting may be supplied to the fabric assembly to form a intermediate layer between the upper and lower sheets, by inserting the soft batting layer into the turning ring as the fabric assembly is inverted. In the preferred embodiment, the turning ring is an elongated ring having a leg projecting from each end thereof between a pair of feed rollers. The fabric assembly is fed through the feed rollers and around the circumference of the turning ring, and is pulled therethrough between the upper and lower sheets of the fabric assembly so as to continuously invert the fabric assembly.

10 Claims, 6 Drawing Sheets

COMFORTER ASSEMBLY APPARATUS

TECHNICAL FIELD

The present invention relates generally to an apparatus for assembling a comforter, or the like, and more particularly to an improved comforter assembly apparatus which will produce a continuous comforter having a soft batt sewn between a pair of outer fabric sheets.

BACKGROUND OF THE INVENTION

Typically, a comforter is manufactured by placing the fabric sheet which will be the lower finished layer of the comforter on a table with the finished side of the sheet facing up. A second sheet is then positioned atop the first sheet, with its finished surface facing downwardly, so that the finished surfaces of the two sheets are adjacent one another on the table. Three edges of the upper and lower sheets are then sewn together, leaving the fourth edge open. For ease of description, the open edge of the pair of sheets will be described as the forward edge, and the sewn edge of the sheets opposite the forward edge will be described as the rearward edge. A layer of soft batting of the appropriate dimensions to fit within the finished comforter is placed adjacent the rearward edge of the fabric sheets. A person then will reach between the upper and lower fabric sheets to the rearward edge and grasp the soft batt through the rearward edge of the fabric sheets. The rearward edge and soft batt are then pulled forwardly such that the upper and lower fabric sheets are turned inside out as the sheets and batt are pulled. This in turn places the three sewn edges on the inside of the comforter so that there are no unsightly hems showing. The fourth open edge of the completed comforter is then sewn together with a convenient stitch. Conventionally the completed unit is then sewn together with a quilting stitch so as to connect the upper and lower fabric sheets with the soft batt of material therebetween.

The main problem with the conventional method of manufacturing quilts is in the amount of time and labor required to assemble the completed comforter. Each individual comforter requires an upper and lower sheet cut to the correct size, along with a similarly sized soft material bat.

It is therefore a general object of the present invention to provide an improved comforter assembly apparatus.

Another object of the present invention is to provide a comforter assembly apparatus which produces a single continuous laminated product, with a soft material batt sandwiched between upper and lower sheets.

A further object is to provide a comforter assembly apparatus which does not require a separate manual operation to invert the upper and lower sheets to their final finished appearance with the soft batt therebetween.

Yet another object of the present invention is to provide a comforter assembly apparatus which produces a continuous comforter having a pair of edges which are sewn together and inverted within the completed comforter. Still a further object of the present invention is to provide a comforter assembly apparatus which will continually invert a pair of continuous lengths of fabric sheets sewn together along parallel edges.

These and other objects of the present invention will be apparent to those skilled in the art.

SUMMARY OF THE INVENTION

The comforter assembly apparatus of the present invention includes a frame with at least first and second rolls of fabric associated therewith for supplying an upper sheet and a lower sheet to the apparatus. A pair of sewing machines are mounted on the frame so as to attach the side edges of the upper and lower sheets to form a continuous fabric assembly. The fabric assembly surrounds and is pulled through the interior of a turning ring, so as to continuously invert the fabric assembly into an inside out condition. A third layer of soft batting may be supplied to the fabric assembly to form an intermediate layer between the upper and lower sheets, by inserting the soft batting layer into the turning ring as the fabric assembly is inverted. In the preferred embodiment, the turning ring is an elongated ring having a leg projecting from each end thereof between a pair of feed rollers. The fabric assembly is fed through the feed rollers and around the circumference of the turning ring, and is pulled therethrough between the upper and lower sheets of the fabric assembly so as to continuously invert the fabric assembly.

DESCRIPTION OF THE PREFERRED EMBODIMENT

Figure 1:
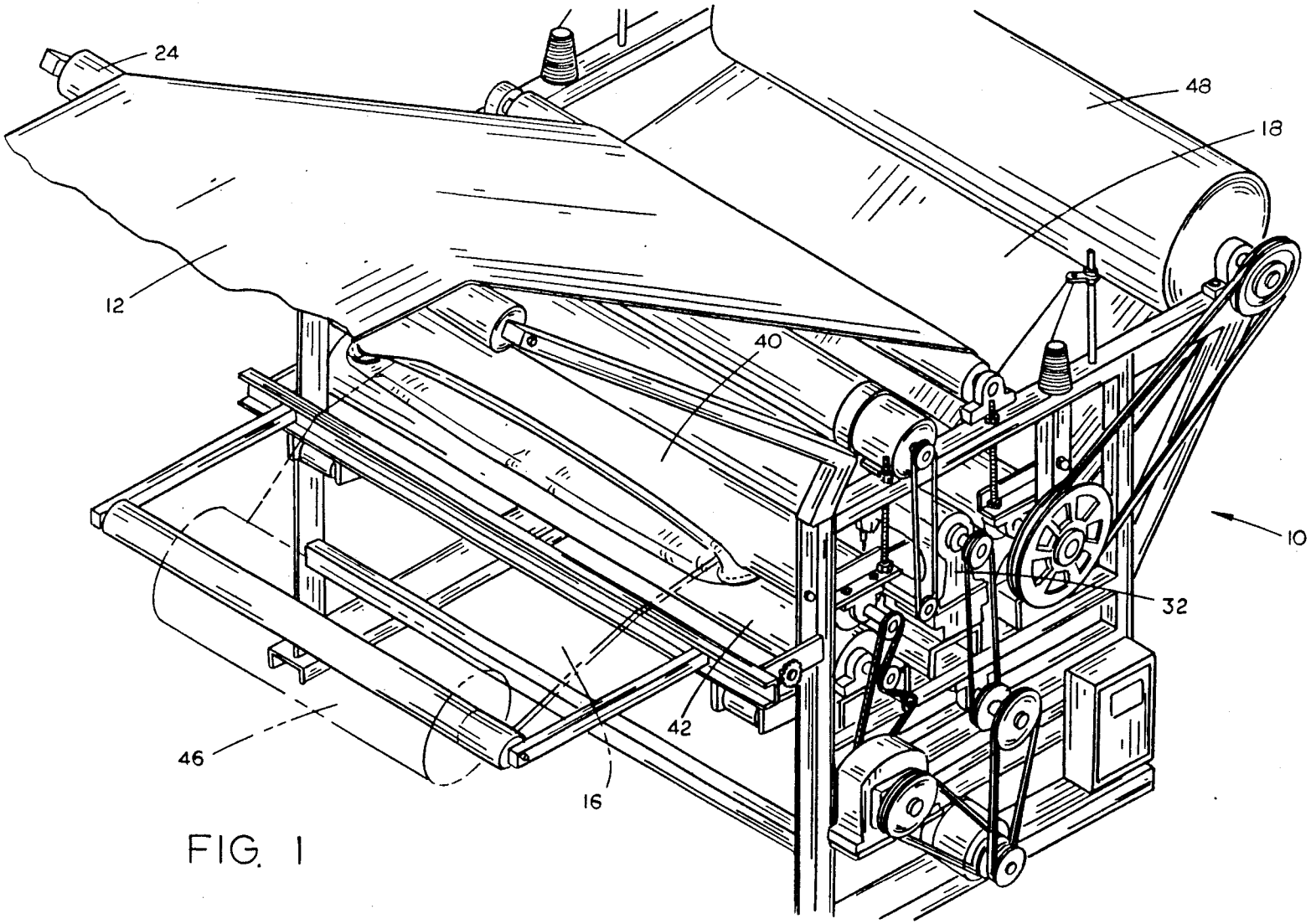
FIG. 1 is a perspective view of the comforter assembly apparatus of the present invention.

Referring now to the drawings, in which similar or corresponding parts are identified with the same reference numeral, and more particularly to FIG. 1, the comforter assembly apparatus of the present invention is designated generally at 10 and operates to sew an upper continuous fabric sheet 12 to a lower continuous fabric sheet 14, turn the upper and lower sheets 12 and 14 inside out, and insert a continuous soft batting layer 16 between the inverted sheets to form a continuous roll of assembled comforter material designated generally at 18. In FIG. 1, the soft batting layer 16 is shown in broken line so as to more clearly show the operation of a free floating turning ring in turning upper and lower layers 12 and 14 inside out.

Figure 2:
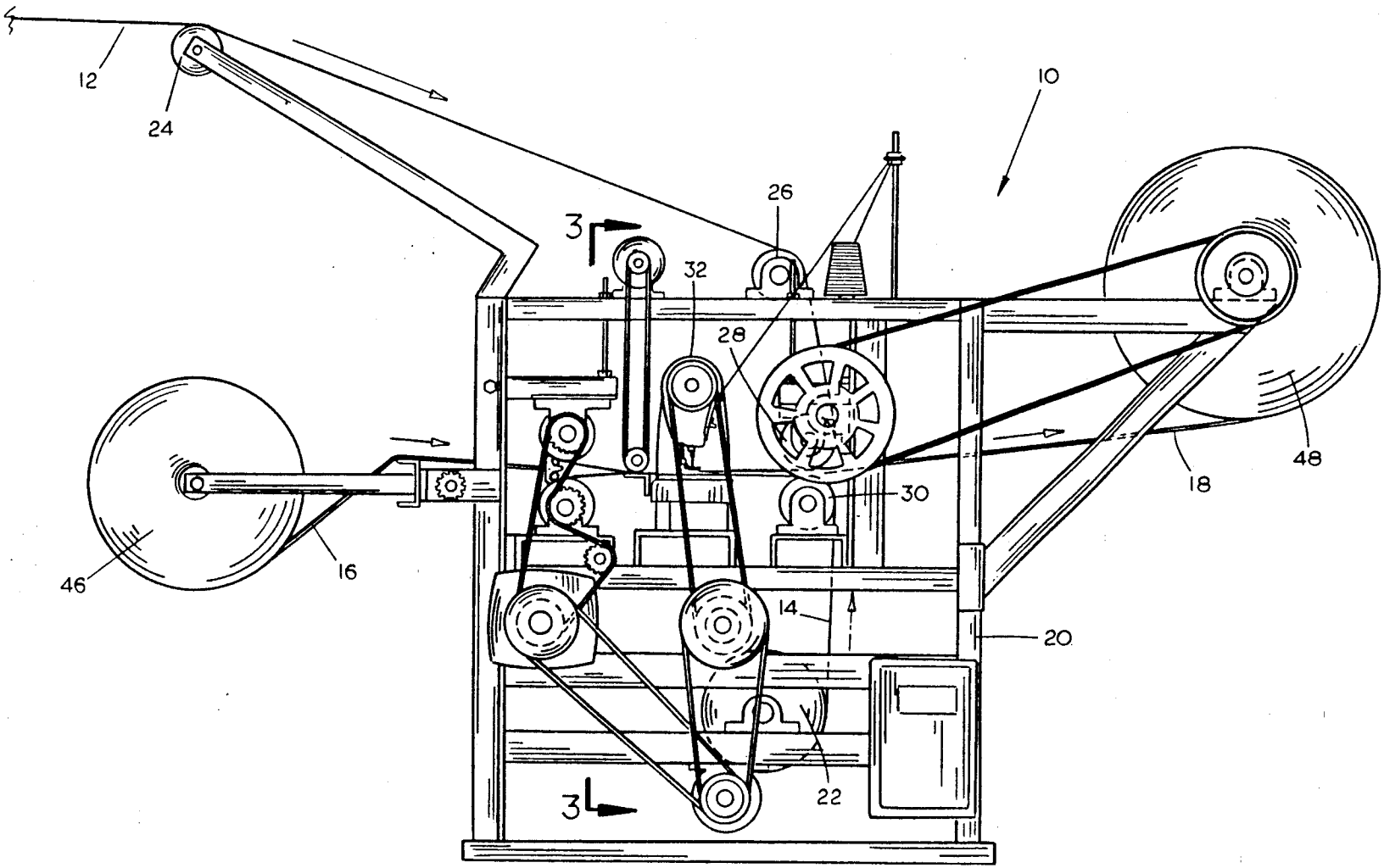
FIG. 2 is a side elevational view as viewed from the right side of FIG. 1.
Figure 4:
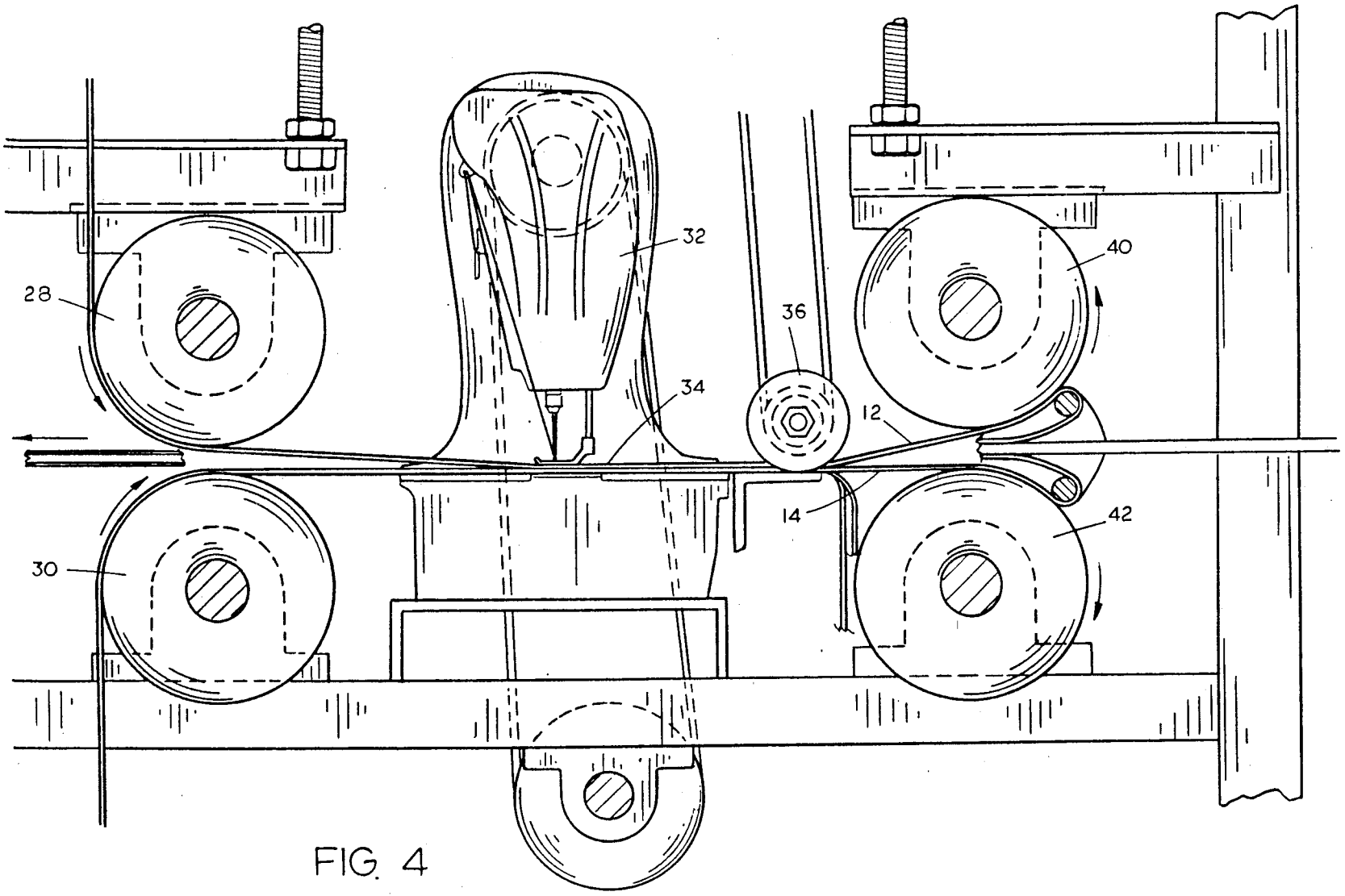
FIG. 4 is a super enlarged sectional view taken at lines 4—4 in FIG. 3.

Referring now to FIG. 2, a tubular frame 20 supports the majority of the operating components of the comforter assembly apparatus 10. In the preferred embodiment of the invention, a roll of upper fabric sheet is operably mounted adjacent the assembly apparatus 10, and thus is not shown in the Figures. A roll of fabric material 22 is rotatably mounted on frame 20 and will provide material for lower continuous fabric sheet 14. As shown in the drawing, upper fabric sheet 12 is directed over a pair of rollers 24 and 26 before being directed generally vertically downward to an idler roller 28, where fabric sheet 12 is redirected to a generally horizontal orientation. Lower fabric sheet 14 extends generally vertically upwardly from roller 22 and around a second idler roller 30 to a generally horizontal orientation adjacent and aligned below upper fabric sheet 12. As shown more specifically in FIG. 4, the side edges of upper and lower sheets 12 and 14 extend from idler rollers 28 and 30 through a sewing machine 32 where they are sewn together to form a continuous hem 34.

Figure 3:
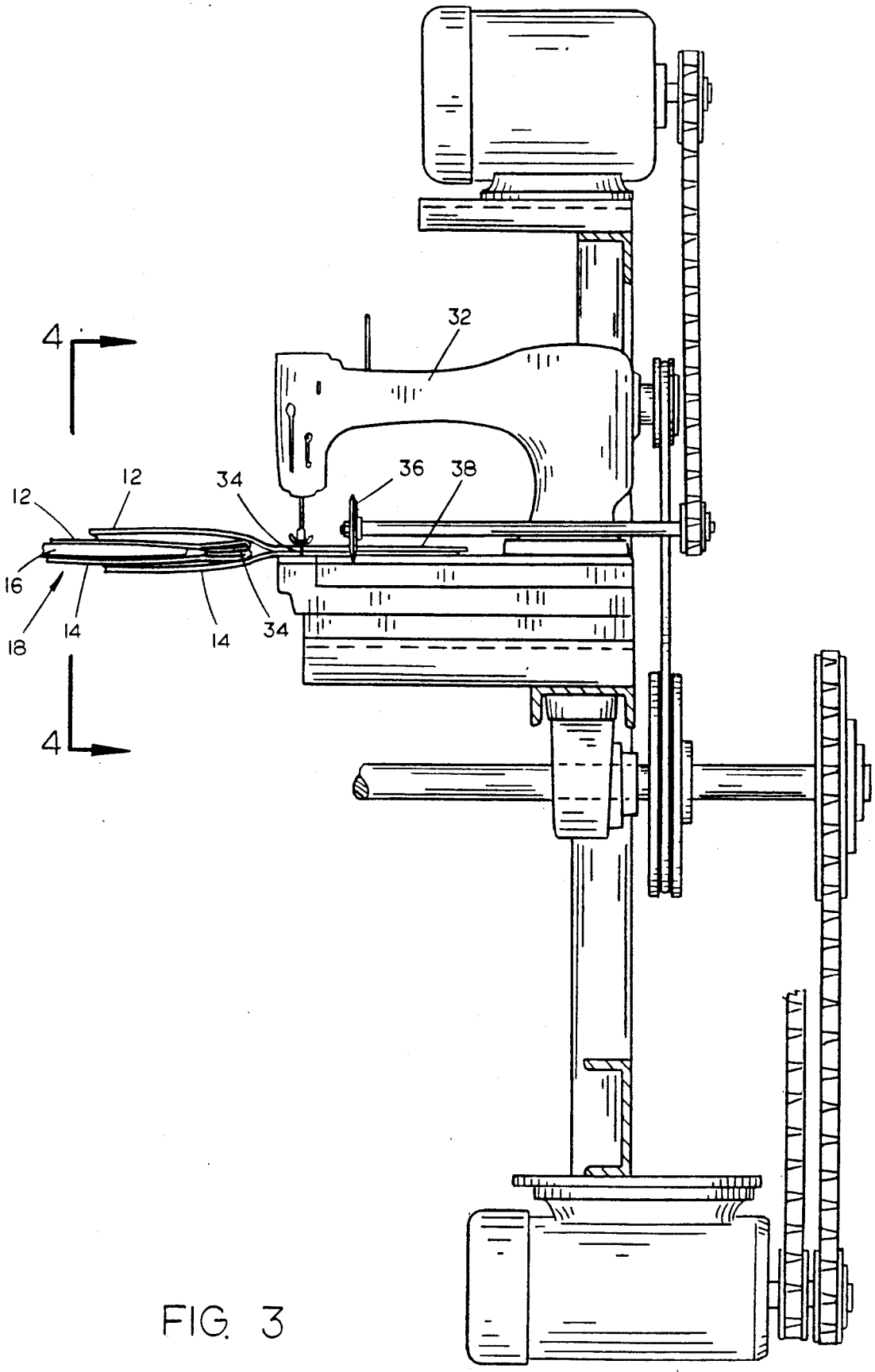
FIG. 3 is an enlarged partial sectional view taken at lines 3—3 in FIG. 2.

A trimming wheel 36 is rotatably mounted adjacent and downstream of sewing machine 32, and will trim off excess material 38 from hem 34, as shown in FIG. 3. Once the side edges have been hemmed, fabric sheets 12 and 14 extend between a pair of upper and lower feeder rollers 40 and 42, respectively. Upper and lower sheets 12 and 14 extend around the circumference of an elongated turning ring 44, and are then pulled through ring 44 so as to turn the hemmed sheets 12 and 14 inside out, as shown in FIGS. 1 and 6.

Batting layer 16 extends from a roll of batting 46 and between upper and lower sheets 12 and 14 into turning ring 44, as shown in FIG. 1. The assembled comforter 18 is threaded between upper and lower sheets 12 and 14 (see FIG. 3), and extends rearwardly out of frame 20 onto a take-up reel 48. Take-up reel 48 is powered so as to pull assembled comforter material 18 through turning ring 44 and place a continuous tension thereon.

Figure 5:
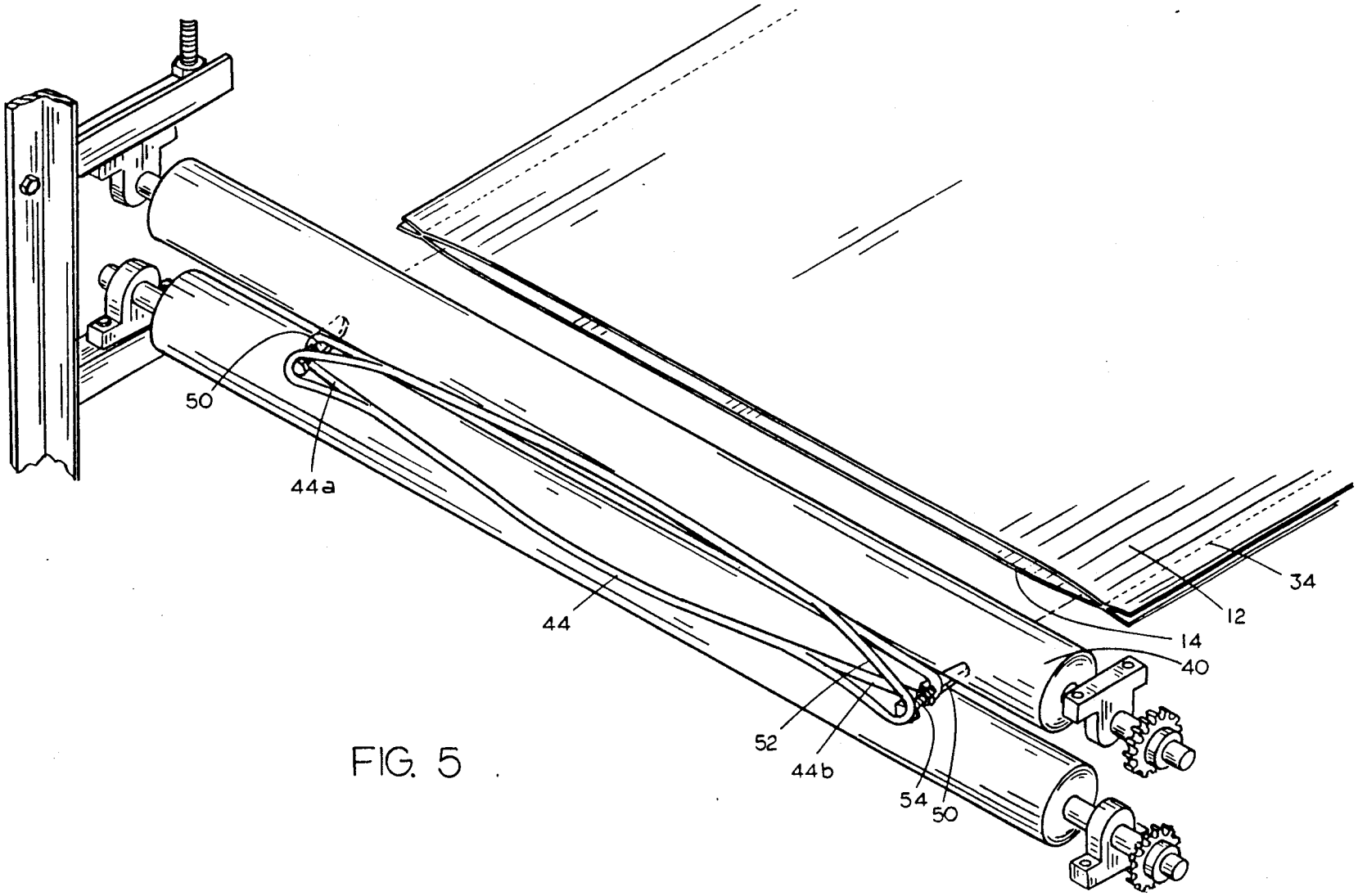
FIG. 5 is an enlarged perspective view of the free floating turning ring and feed rollers, with a lead edge of a pair of fabric sheets located to be threaded through the feed rollers and thence through the turning ring.
Figure 6:
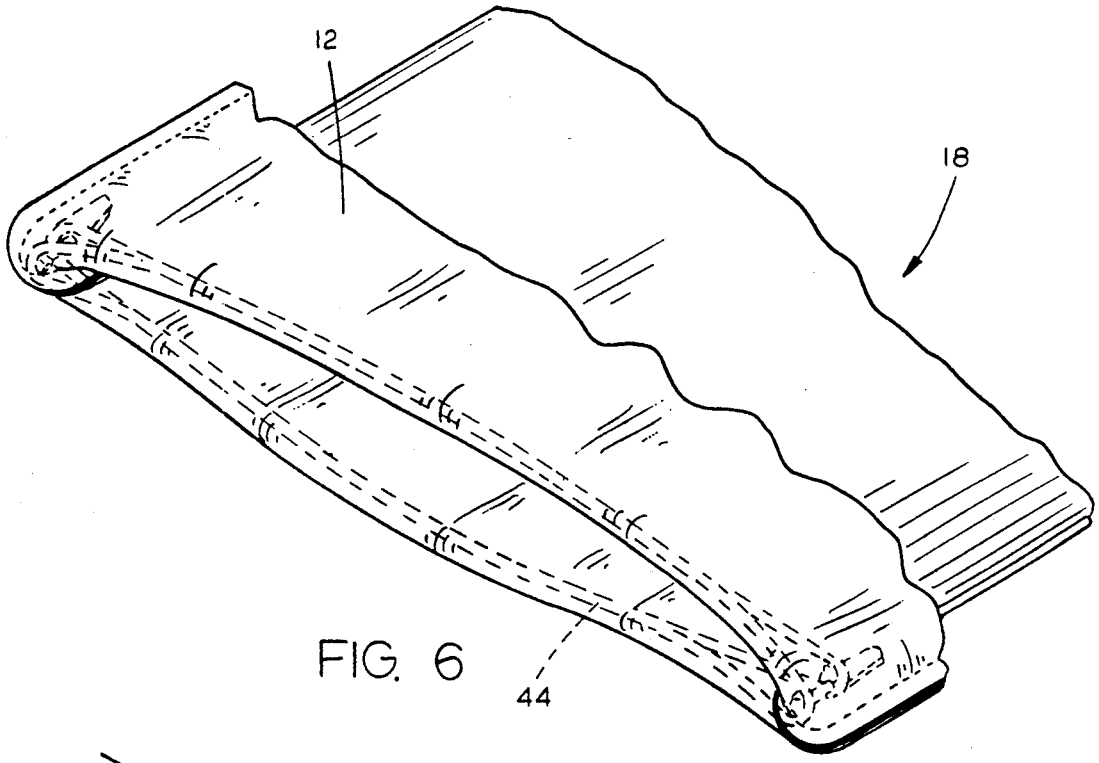
FIG. 6 is a pictorial view showing the free floating turning ring turning the layers of fabric inside out.
Figure 7:
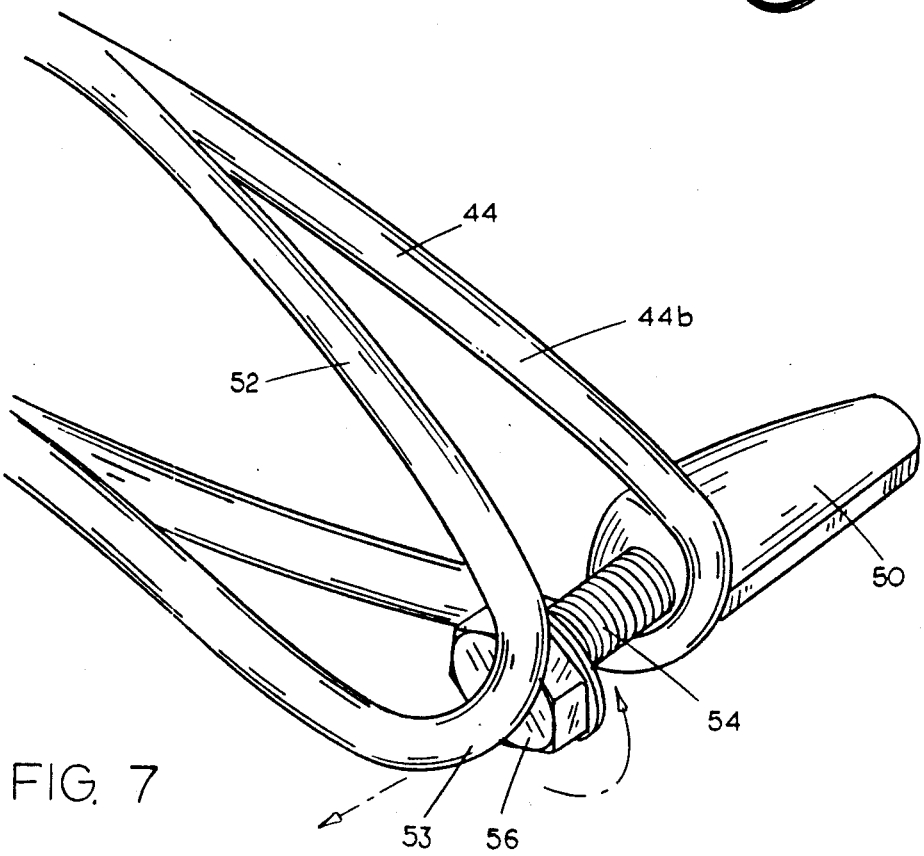
FIG. 7 is a super enlarged perspective view of one end of the turning ring.

Referring now to FIGS. 5, 6 and 7, turning ring 44 is an elongated ring formed from a rigid rod oriented within a generally vertical plane. Each end 44*a* and 44*b* of ring 44 has a guide leg 50 attached thereto projecting horizontally therefrom. Guide leg 50 is slightly tapered and extends a length so as to extend between feed rollers 40 and 42. A U-shaped loop 52 is mounted at each end of ring 44 and diverges from ring 44. Each loop 52 imitates the end of ring 44, and has the same general shape thereof, such that the bottom 53 of each loop 52 is spaced from ring end 44*a* and 44*b*. A bolt 54 is threaded into each guide leg 50, with the bolt head 56 located so as to abut the bottom 53 of each loop 52. Rotation of bolt 54 will thereby cause loop 52 to diverge further away from the associated end of ring 44, or closer thereto. Because the center portion of ring 44 is wider than the ends 44*a* and 44*b*, loops 52 will increase the distance which hem 34 must travel during the inverting process, such that the assembled, inverted combination does not bunch or stretch as it is produced. Adjustment of the distance between loop bottoms 53 and the associated ring-ends 44*a* and 44*b* permits inversion of two dissimilar materials with different elasticity.

Turning ring 44 "floats" with legs 50 riding between feed rollers 40 and 42. This "floating" is caused by the movement of upper and lower sheets 12 and 14 through feed rollers 40 and 42 so as to "push" turning ring 44 away from feed rollers 40 and 42. At the same time, the tension placed on assembled comforter material 18 pulling upper and lower sheets 12 and 14 (along with batting layer 16) through the interior of ring 44, "pulls" ring 44 towards feed rollers 40 and 42. These two opposing "pushing" and "pulling" forces cause ring 44 to "float" between sheets 12 and 14 as they are being turned about turning ring 44. Thus, turning ring 44 allows a continuous sheet of assembled comforter material to be produced by comforter assembly apparatus 10.

Whereas the invention has been shown and described in connection with the preferred embodiments thereof, it will be understood that many substitutions, modifications and additions may be made which are within the intended broad scope of the appended claims. For example, turning ring 44 could be rigidly mounted on legs which extend beyond the location where the sheets are sewn together. This would eliminate the need for feed rollers 40 and 42, but would require materials with very low friction, so that the assembled sheets could be "pulled" around and through the turning ring. In addition, adhesive could be utilized in place of sewing machines to connect the upper and lower sheets. Thus, there has been shown and described an improved comforter assembly apparatus.

I claim:

1. A method for assembling a comforter, comprising the steps of:

providing an upper sheet;

providing a lower sheet;

attaching the corresponding side edges of said upper and lower sheet together to form a continuous fabric assembly;

providing a turning ring means for inverting the fabric assembly into an inside-out condition;

providing a pair of feed rollers extending along the entire transverse width of the fabric to feed the fabric assembly therebetween;

providing take-up reel means for taking up the inverted fabric assembly from the turning ring means;

operating said feed rollers and take-up reel means to continuously and uniformly feed the entire width of the fabric assembly around the circumference of said turning ring means in a direction perpendicular to the plane of the ring and pulling said fabric assembly through the interior of the turning ring means in the opposite direction, such that the fabric assembly is continuously inverted into an inside-out condition.

2. The method of claim 1, further comprising the steps of:

providing a continuous batting layer;

inserting said batting layer through said turning ring means and pulling said batting layer therethrough with said fabric assembly, such that said inverted fabric assembly has a batting layer between the upper and lower sheets when pulled from said turning ring means.

3. A comforter assembly apparatus, comprising:

a frame;

a first source of fabric, for supplying an upper sheet to said frame;

a second source of fabric, for supplying a lower sheet to said frame;

attachment means operably mounted on said frame for attaching the side edges of said upper sheet of fabric to the side edges of said lower sheet of fabric, to form a fabric assembly;

a pair of feed rollers operably mounted on said frame so as to feed the fabric assembly therebetween;

a turning ring means operably associated with said feed rollers for continuously inverting the fabric assembly into an inside-out condition as it is fed from said feed rollers, including:

an elongated rigid ring formed from a rod having first and second ends;

a first leg attached to said first end, having a free end projecting perpendicular to the plane of said ring and extending between said feed rollers when in an operating position; and a second leg attached to said second end, having a free end projecting perpendicular to the plane of said ring and extending between said feed rollers when in an operating position; and take-up reel means for pulling the inverted fabric assembly through said turning ring means.

4. A comforter assembly apparatus, comprising:

a frame;

a first source of fabric, for supplying an upper sheet to said frame;

a second source of fabric, for supplying a lower sheet to said frame;

attachment means operably mounted on said frame for attaching the side edges of said upper sheet of fabric to the side edges of said lower sheet of fabric, to form a fabric assembly; and means operably associated with said frame for continuously inverting the fabric assembly into an inside-out condition, including:

a pair of feed rollers operably mounted on said frame so as to feed the fabric assembly therebetween; and a turning ring means operably associated with said feed rollers for continuously inverting the fabric assembly into an inside-out condition as it is fed from said feed rollers;

said turning ring means including:

an elongated rigid ring formed from a rod having first and second ends;

a first leg attached to said first end and projecting perpendicular to the plane of said ring and extending between said feed rollers when in an operating position; and a second leg attached to said second end projecting perpendicular to the plane of said ring and extending between said feed rollers when in an operating position; and a generally U-shaped loop having a closed bottom end and a pair of legs mounted at each end of said ring and having the closed bottom portion of each loop spaced from the ring end such that material being inverted by said ring will travel around the loop in addition to the ring at each end of the ring.

5. The comforter assembly apparatus of claim 3, further comprising a source of soft batting, for supplying an intermediate layer of batting, a sheet of said batting being inserted through said turning ring means and between said upper and lower sheets of said inverted fabric assembly.

6. The comforter assembly apparatus of claim 3, further comprising a pair of idler rollers rotatably mounted on said frame adjacent said attachment means, so as to direct an upper sheet and lower sheet to a generally parallel and aligned orientation prior to attachment together.

7. The comforter assembly apparatus of claim 3, wherein said attachment means includes a sewing machine mounted to said frame adjacent each side edge of said upper and lower sheets, for attaching said upper and lower sheets continuously along their side edges.

8. The comforter assembly apparatus of claim 3, further comprising operable means for adjusting the distance between the closed bottom end of each loop and the associated ring end.

9. A comforter assembly apparatus, comprising:

a frame;

a first source of fabric, for supplying an upper sheet to said frame;

a second source of fabric, for supplying a lower sheet to said frame;

attachment means operably mounted on said frame for attaching the side edges of said upper sheet of fabric to the side edges of said lower sheet of fabric, to form a fabric assembly;

a pair of feed rollers operably mounted on said frame so as to feed the fabric assembly therebetween;

a turning ring means operably associated with said feed rollers for movement independent of said frame for continuously inverting the fabric assembly into an inside-out condition as it is fed from said feed rollers; and take-up reel means for pulling the inverted fabric assembly through said turning ring means;

said turning ring means located within the fabric assembly being inverted such that the take-up reel continuously pulls the inverted fabric assembly and turning ring means towards the feed rollers, and such that the feed rollers continuously push away said turning ring means when operated to feed fabric, such that the turning ring floats independently of the frame supported only by the fabric assembly flowing around and inverted by said turning ring means.

10. A comfortable assembly apparatus, comprising:

a frame;

a first source of fabric, for supplying an upper sheet to said frame;

a second source of fabric, for supplying a lower sheet to said frame;

attachment means operably mounted on said frame for attaching the side edges of said upper sheet of fabric to the side edges of said lower sheet of fabric, to form a fabric assembly;

a pair of feed rollers operably mounted on said frame and extending from side to side of said upper and lower sheets so as to uniformly feed the fabric assembly therebetween;

a turning ring means operably associated with said feed rollers for continuously inverting the fabric assembly into an inside-out condition as it is fed from said feed rollers; and take-up reel means for pulling the inverted fabric assembly through said turning ring means.

* * * * *